US010731449B2

(12) United States Patent
Stalder

(10) Patent No.: US 10,731,449 B2
(45) **Date of Patent: *Aug. 4, 2020**

(54) SAGD STEAM TRAP CONTROL

(71) Applicants: ConocoPhillips Canada Resources Corp., Calgary (CA); ConocoPhillips Surmont Partnership, Calgary (CA); Total E&P Canada Ltd., Calgary (CA)

(72) Inventor: John L. Stalder, Calgary (CA)

(73) Assignees: ConocoPhillips Canada Resources Corp., Calbary, AB (CA); ConocoPhillips Surmont Partnership, Calgary, AB (CA); Total E&P Canada Ltd., Calgary, AB (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/913,553

(22) Filed: Mar. 6, 2018

(65) Prior Publication Data

US 2018/0195374 A1 Jul. 12, 2018

Related U.S. Application Data

(63) Continuation of application No. 13/774,847, filed on Feb. 22, 2013, now Pat. No. 10,202,831.

(60) Provisional application No. 61/601,726, filed on Feb. 22, 2012.

(51) Int. Cl.
*E21B 43/24* (2006.01)

(52) U.S. Cl.
CPC ..... *E21B 43/2406* (2013.01)

(58) Field of Classification Search
None
See application file for complete search history.

(56) References Cited

U.S. PATENT DOCUMENTS

| | | | |
|---|---|---|---|
| 5,589,775 | A | 12/1996 | Kuckes |
| 6,158,510 | A | 12/2000 | Bacon |
| 6,257,334 | B1 | 7/2001 | Cyr |
| 7,559,375 | B2 | 7/2009 | Dybevik |
| 7,631,694 | B2 | 12/2009 | Struyk |
| 7,975,763 | B2 | 7/2011 | Banerjee |
| 2008/0217001 | A1 | 9/2008 | Dybevik |
| 2008/0275648 | A1 | 11/2008 | Illfelder |
| 2009/0188661 | A1 | 7/2009 | Bizon |
| 2009/0283272 | A1 | 11/2009 | Da Silva Amarai |

(Continued)

FOREIGN PATENT DOCUMENTS

| | | |
|---|---|---|
| WO | WO201092338 | 8/2010 |
| WO | WO2011098328 | 8/2011 |

OTHER PUBLICATIONS

Gates and Leskiw "Impact of steam trap control on performance of steam-assisted gravity drainage," J. Petroleum Sci. Eng. 75:215-22 (2010).

(Continued)

*Primary Examiner* — Andrew Sue-Ako
(74) *Attorney, Agent, or Firm* — Boulware & Valoir

(57) ABSTRACT

Methods and systems related to SAGD injection and/or production wells that utilize flow distribution control devices. Additionally, methods and systems using limited vertical spacing separating the wells are described. These methods and systems improve steam assisted gravity drainage (SAGD) oil production, reduce SAGD start-up time and costs, and improve overall SAGD performance.

15 Claims, 2 Drawing Sheets

(56) References Cited

U.S. PATENT DOCUMENTS

| | | | | |
|---|---|---|---|---|
| 2009/0288827 | A1 | 11/2009 | Coskuner | |
| 2010/0243249 | A1* | 9/2010 | Fang | E21B 43/2406 166/272.3 |
| 2011/0232903 | A1 | 9/2011 | Dreher | |

OTHER PUBLICATIONS

Mazerov "Innovative systems enhance ability to achieve selective isolated production in horizontal wells," Drilling Contractor May/Jun. 124-129 (2008).
Baker Hughes, "Baker Oil Tools Installs Two Million Feet of Inflow Control Completion Systems", Jun. 30, 2008 press release, Houston, TX.
Elliot and Kovscek, "A Numerical Analysis of the Single-Well Steam Assisted Gravity Drainage Process (SW-SAGD)".
Stalder, "Test of SAGD Flow Distribution Control Liner System, Surmont Field, Alberta, Canada." J. Canadian Petroleum Tech., In Process.
Pao Richard H. F., "Fluid Mechanics", John Wiley & Sons, pp. 286-290 (1965).
Butler R. M., "Thermal Recovery of Oil & Bitumen", Chapter 7: "Steam-Assisted Gravity Drainage", Prentice Hall, (1991).
PCT Search Report for related Application Serial No. PCT/US2013/027449.
Baker Hughes, "EQUALIZER Sand and Inflow Control Technology—Optimize production with superior sand control in long horizontal wells", Nov. 24, 2011 press release, Houston, TX.

* cited by examiner

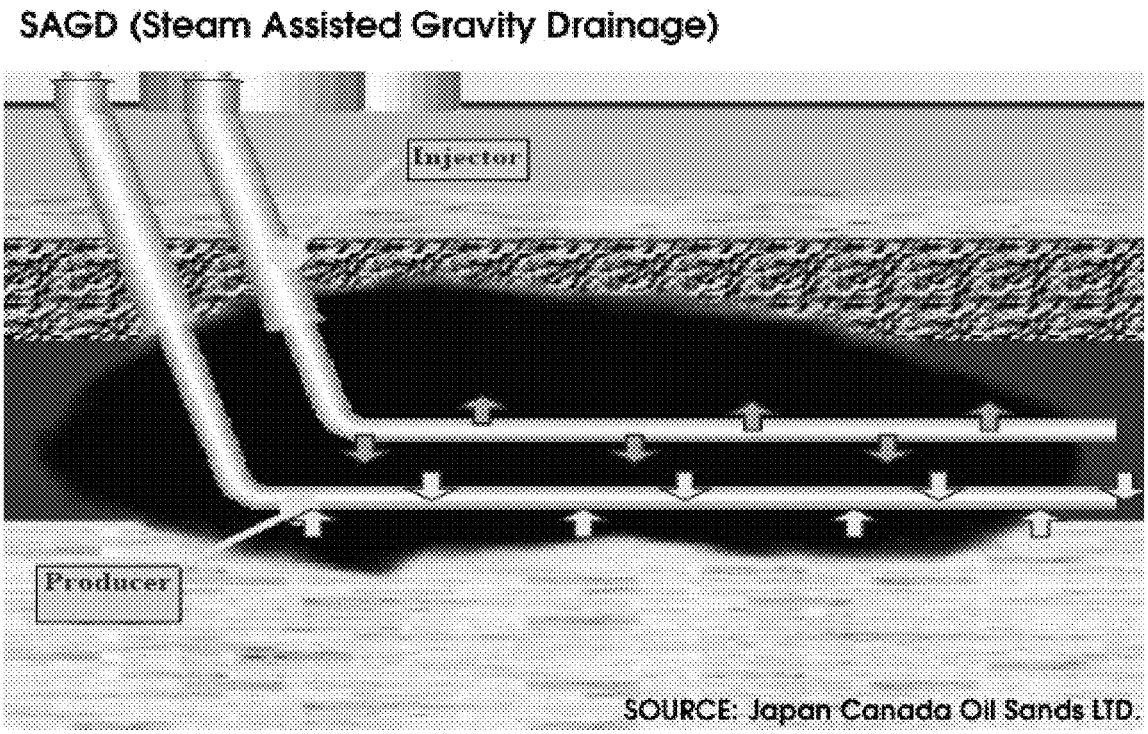
FIGURE 3: Typical uneven steam chamber shown in black (prior art).

SAGD STEAM TRAP CONTROL

CROSS-REFERENCE TO RELATED APPLICATIONS

This application is a continuation of U.S. application Ser. No. 13/774,847, filed Feb. 22, 2013, which claims priority to U.S. Provisional Application Ser. No. 61/601,726, filed Feb. 22, 2012. Each application is incorporated herein in its entirety.

STATEMENT REGARDING FEDERALLY SPONSORED RESEARCH

None.

FIELD OF THE INVENTION

This invention relates to a steam assisted gravity drainage (SAGD) oil production method that reduces SAGD start-up time and costs, and improves overall SAGD performance.

BACKGROUND OF THE INVENTION

Many countries in the world have large deposits of oil sands, including the United States, Russia, and various countries in the Middle East. However, the world's largest deposits occur in Canada and Venezuela. Oil sands are a type of unconventional petroleum deposit. The sands contain naturally occurring mixtures of sand, clay, water, and a dense and extremely viscous form of petroleum technically referred to as "bitumen," but which may also be called heavy oil or tar.

The crude bitumen contained in the Canadian oil sands is described as existing in the semi-solid or solid phase in natural deposits. Bitumen is a thick, sticky form of crude oil, so heavy and viscous (thick) that it will not flow unless heated or diluted with lighter hydrocarbons. The viscosity of bitumen in a native reservoir is high. Often times, it can be in excess of 1,000,000 cP. Regardless of the actual viscosity, bitumen in a reservoir does not flow without being stimulated by methods such as the addition of solvent and/or heat. At room temperature, it is much like cold molasses.

Due to their high viscosity, these heavy oils are hard to mobilize, and they generally must be made to flow in order to produce and transport them. One common way to heat bitumen is by injecting steam into the reservoir. The quality of the injected fluid is very important to transferring heat to the reservoir to allow bitumen to be mobilized. Quality in this case is defined as percentage of the injected fluid in the gas phase. The target fluid quality is near 100% vapor, however, injected fluid in parts of the well can have a quality below 50 percent (more than 50% liquid) due to heat loss along the wellbore. Thus, in many steam injection techniques, the quality of steam drops off farther from the injection point, resulting in uneven heating. This is illustrated in FIG. 3, showing a typical SAGD process with uneven steam chamber shown in black.

Steam Assisted Gravity Drainage (SAGD) is the most extensively used technique for in situ recovery of bitumen resources in the McMurray Formation in the Alberta Oil Sands (Butler, 1991) and other reservoirs containing viscous hydrocarbons. In a typical SAGD process, two horizontal wells are vertically spaced by 4 to less than 10 meters. The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within the steam vapor and heated bitumen and steam condensate chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area where its viscosity increases and the oil mobility is again reduced.

However, gravity is not the only important factor for SAGD. Many studies have shown that the performance and ultimate success of SAGD depends on many factors including reservoir properties, steam chamber development, the length, spacing and location of the two horizontal wells, heat transfer, heat loss, and the ability to impact steam trap control to prevent inefficient production of live steam.

Typically, SAGD wells are drilled about 5 meters apart vertically to achieve steam trap control whereby a gas-liquid (steam-vapor) interface is maintained above the production well to prevent short-circuiting of steam and undue stress on the production well sand exclusion media. In order to establish initial communication between the wells, a startup period where steam is circulated for 3 to 5 months in each well (both production and injection wells) prior to starting SAGD operation is necessary for a successful SAGD recovery. However, this 3 to 5 month startup time increases the overall cost of SAGD because of the amount of steam required and the delay before oil production can begin. Decision makers may limit projects available for SAGD production because of this added cost.

Well characteristics and design are also important to SAGD performance. The standard SAGD well design employs 800 to 1000 meter slotted liners with tubing strings attached near the toe and near the heel in both the injection and the production wells to provide two points of flow distribution control in each well, as illustrated in FIG. 1. However, in the typical SAGD operation, steam heating is uneven, falling off away from the injection point and reducing effectiveness and increasing costs.

As such, there is a need to develop more thermally efficient production techniques while increasing the economic viability of the SAGD process. Conventional reservoir completion practice, with a toe string, limits the minimum liner diameter for a given flow capacity. Thus, a method that reduces material, reduces steam use, reduces the number and size of tubing strings, and reduces startup time while improving SAGD performance is needed.

BRIEF SUMMARY OF THE DISCLOSURE

The present invention relates to a steam assisted gravity drainage (SAGD) oil production method that reduces start-up time and costs, and improves overall SAGD performance. In particular, flow control devices (FCD), including inflow control devices (ICD), are located along the production or injection well or both to control the steam distribution and flow through the wells. This will allow for a reduced the vertical spacing between the injection and production wells, which will decrease SAGD startup time and costs and improve overall SAGD performance.

By reducing the vertical spacing and controlling the steam being injected, a more efficient steam chamber can be produced, resulting in a greater steam/oil interface. This will, in turn, increase the amount of oil recovered. Additionally, a closer vertical spacing will require less materials, startup time, startup cost, and reduce steam-oil ratio. Ultimately, this improved production and lower costs will lead to capital investment savings and make SAGD oil production viable in a larger number of reservoirs.

In a typical SAGD design, two parallel horizontal wells are drilled in the formation. FIG. 1 illustrates an upper well 101 that injects steam, possibly mixed with solvents or other fluids, and a lower well 102, traditionally one about 4 to 6 meters below the upper well 101, that collects the heated crude oil or bitumen that flows out of the formation, along with any water from the condensation of injected steam. Both wells may include slotted liners or tubing strings.

In a typical SAGD operation, steam is injected into both tubing strings (at the toe and heel) at controlled rates to place more or less steam at each end of the well to achieve better overall steam distribution along the horizontal injection well. Likewise, the production well is initially 'gas-lifted' through both tubing strings at rates controlled to provide better inflow distribution along the completion. If steam was injected only at the heel of the injection well, as is typically done, and water and bitumen were produced only from the heel of the production well, the steam chamber tends to develop only near the heel portion of the wells and fall off towards the toe. This would result in limited rates and poor steam chamber development over some portion of the horizontal well. The present invention addresses these prior art limitations, providing a more effective and less costly process.

Flow control devices (FCD) are any device that restricts significant flow of steam vapor into the production well by causing an increased pressure drop with localized high flow rate, or by discriminating between live steam vapor and liquid water or oil such that live steam vapor is met with much higher pressure drop or other throttling measures. FCDs are frequently used with SAGD.

The inventive methods include one or more of the following embodiments:

In one embodiment of the present invention, the vertical spacing between the SAGD wells is less than the traditional 4-10 m. Thus, a horizontal production well with production tubing is placed horizontally in a hydrocarbon reservoir, a horizontal injection well with injection tubing is vertically aligned less than or equal to approximately 3 meters above said horizontal production tubing. To support the shortened distance, one or more flow control devices, located on the horizontal production tubing liner, are used to preferentially restrict the flow of steam or water, thus preventing inadvertent steam breakthrough before oil is mobilized. FIG. 2 depicts such a design.

In some embodiments, the injecton well 201 may include the FCD 203 for controlling outflow. By slowing flow in areas where steam breakthrough occurs, the steam trap is maintained and maximum production occurs where steam breakthrough has not occurred. Differential flow along the production well 202 allows the steam trap to remain consistent. Additionally, the FCD will allow for the preferential restriction of flow of the steam or water, as needed to maintain the desired steam flow.

In another embodiment, the injector and production tubing are approximately 50% closer than standard injector and production tubing for SAGD, but flow control devices are located on the production tubing, the injector tubing or both.

In the present disclosure, as depicted in FIG. 2, the SAGD injection tubing and production tubing have a vertical spacing between about 0.5 and 3 meters; preferably about 0.5 meters, 0.75 meters, 1.0 meters, 1.25 meters, 1.5 meters, 1.75 meters, 2.0 meters, 2.5 meters and 3 meters; and most preferably, 1, 1.5, 2, 2.5 or 3 meters apart.

There are many commercially available FCD for SAGD. In the present invention, the FCD may be any form of flow control device, inflow control devices or flow regulation systems that regulates flow into (or out of) one or more injection or production wells, regulates placement of steam, and regulates the type of fluids produced. Typically, the FCD allows liquids or hydrocarbons to pass but closes, reduces flow, or restricts flow when less dense or higher velocity gases flow through.

The FCD may be a mechanical device or may be automated. In one embodiment, a mechanical FCD may be selected from a rate sensitive flow restrictor, a rate sensitive flow valve, Halliburton's EQUIFLOW™ ICD, Baker Oil Tools EQUILIZER™ ICD, Schlumberger's RESFLOW™ ICD, and the like. In another embodiment, the FCD may be controlled electronically or hydraulically by temperature, density, hydrocarbon content, or other measurable property of the fluid.

Packers, sliding sleeves, and inflow control devices provide a system for selectively isolating production zones for treatment with steam and for controlling the flow of the produced hydrocarbons (Mazerov, 2008). Many flow control devices are already commercially available for SAGD. Baker Oil EQUALIZER™ Tool technology has used a liner system to control gas and water coning in conventional oil and gas operations since 1998 (Baker Hughes, 2008). U.S. Pat. No. 7,559,375 discloses a flow control device for choking pressures in fluids flowing radially into a drainage pipe of a well. However, such devices may increase the cost of SAGD operations.

In another embodiment, a process of SAGD hydrocarbon production, is provided comprising: installing a horizontal production well with production tubing and a horizontal injection well with injection tubing, wherein said injection and production tubing are parallel and have a vertical spacing of 3 meters or less in a subterranean hydrocarbon-containing reservoir; injecting steam into said injection well, wherein at least one of said injection tubing and/or said production tubing has one or more flow control devices that preferentially restricts the flow of steam vapor; controlling the flow of steam with said one or more flow control devices to maximize steam chamber growth; and producing hydrocarbons from said production well after an optional startup period.

The flow control devices can along the production tubing, or injection tubing, or both, and/or limit steam vapor passage relative to liquids.

The flow control devices can be a rate sensitive flow restrictor and a rate sensitive flow valve, or any other suitable FCD.

Preferably, the method eliminates the startup period, but it can also merely reduce same, e.g., to between 1 and 30 days.

Another embodiment is an SAGD hydrocarbon production system, comprising: a horizontal production well with production tubing placed horizontally in a hydrocarbon reservoir, said production tubing comprising a plurality of flow control devices that preferentially restrict the flow of steam vapor; and a horizontal injection well with injection tubing parallel to said horizontal production tubing and vertically spaced 3 meters or less above said horizontal production tubing.

In another embodiment, an SAGD hydrocarbon production system comprises a horizontal production well with production tubing placed horizontally in a hydrocarbon reservoir, said production tubing comprising a plurality of flow control device that preferentially restrict the flow of steam vapor; and a horizontal injection well with injection tubing, said injection tubing comprising a plurality of flow control devices that preferentially restrict the flow of steam vapor, said injection tubing parallel to said horizontal production tubing and vertically spaced 3 meters or less above said horizontal production tubing.

Yet another embodiment provides an improved method of SAGD production of hydrocarbons, said method comprising injecting steam into an upper horizontal well to heat hydrocarbons, allowing gravity drainage of heated hydrocarbons to a lower horizontal well, and producing said heated hydrocarbons from said lower horizontal well, the improvement comprising separating said upper horizontal well said lower horizontal well by ≤3 meters, and controlling the flow of steam in one or both of said wells using a flow control device to provide even distribution of steam along said one or both of said wells.

As used herein, the term 'hydrocarbon' refers to petroleum components, including conventional crude, heavy oil, bitumen, tar sands, asphaltenes, and the like. In one embodiment, SAGD is used with high viscosity oils, tars or bitumens that require heating to liquefy or produce the hydrocarbon. In some instances, SAGD may be used with other hydrocarbon reservoirs as an enhanced oil recovery technique or a method to produce additional hydrocarbons from a reservoir. In one embodiment, SAGD is used to produce bitumen from a subterranean reservoir.

As used herein, the term "SAGD" includes steam heating and gravity drainage production methods, even where combined with other methods such as solvent assisted production methods, EM heating methods, cyclic methods and the like.

As used herein, the term "FCD" includes any device that restricts significant flow of steam vapor into the production well by causing an increased pressure drop with localized high flow rate, or by discriminating between live steam vapor and liquid water or oil such that live steam vapor is met with much higher pressure drop or other throttling measures. It can be controlled by electronically, mechanically, or hydraulically by temperature, density, hydrocarbon content, or other measurable property of the fluid.

As used herein, the term "startup" refers to a period of time used to place SAGD wells in fluid communication. Any means of achieving that communication can be used. Dual steam circulation in both the injection and production wells for 3 to 5 months is the most common method used to place the wells in communication. However, steam injections in the startup period are a costly expenditure for SAGD. Cost-based improvements to the startup period have utilized other forms of heat, such as electrical, magnetic, or radio frequency heaters, to warm the reservoir and reduce the amount of steam needed.

By the term "providing," as used herein, we do not mean to imply contemporaneous drilling or lining of wells, and existing wells and liners can be used, if correctly spaced and fitted with the appropriate flow control devices. However, in many cases, at least one well will be drilled since current well spacing is typically at least 5 meters.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| SAGD | steam assisted gravity drainage |
| FCD | Flow control device |

BRIEF DESCRIPTION OF THE DRAWINGS

A more complete understanding of the present disclosure and benefits thereof may be acquired by referring to the follow description taken in conjunction with the following figures:

FIG. 3: Typical prior art SAGD showing uneven steam chamber in black.

DETAILED DESCRIPTION

Turning now to the detailed description of the preferred arrangement or arrangements of the present disclosure, it should be understood that the inventive features and concepts may be manifested in other arrangements and that the scope of the disclosure is not limited to the embodiments described or illustrated herein. It should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

Figure 1:
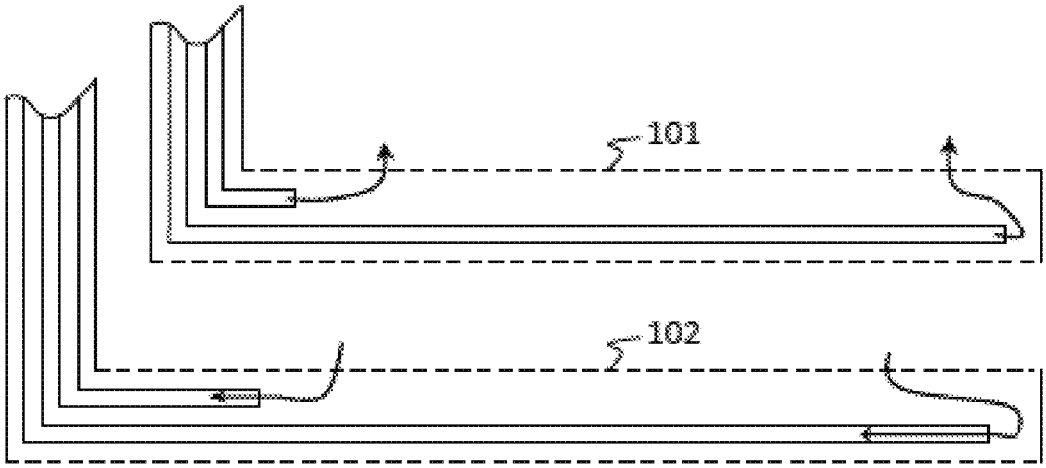
FIG. 1 (PRIOR ART)
FIG. 1: Typical prior art SAGD completion design with toe and heel tubing in both a steam injection liner and a producing liner.

A typical SAGD with the toe/heel tubing is depicted in FIG. 1. Before SAGD operations begin, a steam circulation preheating step is require to place both wells in fluid communication. During SAGD operations, the injected steam forms a steam chamber that interacts with the oil to improve mobility. However, thermocouple and other monitoring information gathered during the first few months of operation of a typical toe/heel SAGD design suggest that the distribution of the developing steam chambers was, on average, less than 50% of the full completion length of the wells and some steam was 'breaking through' into the production well.

While much of the imperfect conformance was undoubtedly driven by variations in geologic properties for the different wells, well undulation, non-parallel well placement, and wellbore heat exchange effects, hydraulic gradients within the liners and tubing strings also could contribute to non-uniform distribution of the heated region around the wells. These results suggest that steam chamber growth (conformance) can be improved beyond the simple toe/heel tubing method displayed in FIG. 1.

The present invention is an improvement on the traditional SAGD completion design because it will reduce the non-uniform distribution of heated regions and improve conformance. Specifically, one aspect of the present design is the use of flow distribution control devices to preferentially place the injected steam. Flow distribution control is essential to improving early steam chamber conformance.

Flow distribution control was initially tested to improve early steam chamber conformance. Here, a flow distribution liner system utilizing Baker Oil Tools EQUALIZER™ liners was designed to test whether early SAGD operation and steam chamber conformance could be improved over the performance delivered by the standard toe/heel tubing design used in FIG. 1.

Using the FCD during a typical SAGD process confirmed that building flow distribution control in the liner eliminated the need for toe tubing and that a target flow capacity could be achieved with a smaller liner. Using a smaller liner without toe tubing reduces the amount of steel placed in the ground. Ultimately, the cost savings of smaller liners and casing along with the elimination of the toe strings more than offsets the added cost of flow distribution controllers regardless of improved performance of these wells. However, this can be further improved. Further experiments show that a smaller distance between the horizontal wells could also improve SAGD performance.

Figure 2:
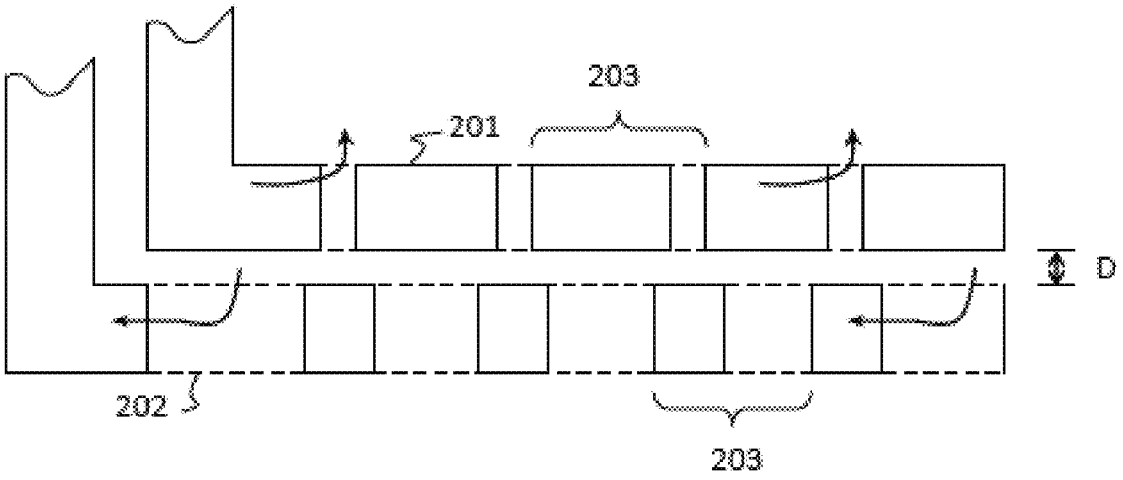
FIG. 2: SAGD completion design with flow control devices and limited spacing between an injection well on top and a production well on bottom.

FIG. 2 depicts one embodiment of the present invention in which the vertical spacing between the horizontal wells is smaller than a typical SAGD completion design. Experiments showed that steam trap control is impacted by an FCD 203 built into the production well 202, preferably in the liner itself or in a toe tubing string within the liner. Thus, using the FCD 203 in a liner or in a toe tubing string allows a shortened separation "D" between the injection 201 and production 202 well from a standard 5 meters or more down to between 3 meters to less than one meter, preferably about 2 meters without increasing steam break through.

Furthermore, when D is small, the preheating circulation period before SAGD operation can be determined primarily by conduction heating. A minimum temperature of 80° C. between the horizontal wells 201, 202 is necessary. Because the heat flowing radially outward from a line source such as a horizontal well is highly non-linear, reducing the spacing "D" between the wells 201, 202 can greatly reduce the time to reach the target temperature. Thus, the 3 months that is required for preheating wells separated by 5 meters can be reduced to 2 weeks of preheating with a 2 m spacing, assuming dependent parameters such as the porosity, viscosity, flow and other reservoir parameters are kept the same. This change in vertical spacing offers an exponential reduction in the startup time prior to SAGD operation. Additionally, there is a significant reduction in steam, heat or water, required for the preheating operation.

When using the Baker Oil Tools EQUALIZER™ liners in SAGD designs with smaller vertical spacing, the FCDs were able to close the slots in the liners. In the liner, the slots could be selectively closed to allow for placement of steam at various lengths along the injection well. Thus, more steam could be released into the reservoir in sections where the steam trap growth had fallen behind. In the production well, slots could be closed to prevent steam break through. This is especially important as the vertical distance decreases because steam break through results in the production of water without or with a limited amount of hydrocarbons.

By decreasing "D" to less than one meter apart, startup time may be reduced to less than 1 day. If the injection well 201 and production well 202 are placed less than one meter apart, injection may be distributed along the length of the injection well 201 and a production well with an FCD 203 will allow the steam trap to form. In another embodiment of the present disclosure, the injection well 201 and production well 202 may be less than 1 meter apart, where "D" is approximately 90 cm, 80 cm, 70 cm, 60 cm, 50 cm or less.

Flow control is essential if the injection and production wells 201, 202 are less than 1 meter from each other. By using the FCD 203 to control the rate of steam injection along the length of the injection well 201, steam distributes evenly along the length of the injection well 201 allowing even steam chamber formation. This prevent steam fall off away from the injection point and prevents steam breakthrough.

This use of an FCD will also facilitate an even oil production along the length of the production well 202. The FCD 203 distributes produced oil along the length of the production well 202. This will prevent steam break through, and consequent production of water without oil, in the production well, thus promoting further steam chamber growth. Thus, the use of flow distribution control on the injection and/or production wells 201, 202 allows an even steam chamber to form.

We have explained the inventive method with a simple two well system, but of course, additional injection/production wells can advantageously be used as is known in the art. Additionally, the basic SAGD process can be combined with other methodologies, such as cyclic methods, solvent assisted processes, electromagnetic (EM) heating, and the like.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

All of the references cited herein are expressly incorporated by reference for all purposes. The discussion of any reference is not an admission that it is prior art to the present invention, especially any reference that may have a publication date after the priority date of this application. Incorporated references are listed again here for convenience:

U.S. Pat. No. 6,158,510, Bacon, et al., "Steam distribution and production of hydrocarbons in a horizontal well." Exxonmobil Upstream Res Co., (2000).

U.S. Pat. No. 7,559,375, US20080217001, Dybevik, et al., "Flow control device for choking inflowing fluids in a well," Reslink AS, (2008).

WO201092338, Kjoerholt, "Single Well Steam Assisted Gravity Drainage," Statoil, (2010).

WO2011098328, Aakre, et al., "Improvements in Hydrocarbon Recovery," Statoil, (2011).

Baker Hughes, "Baker Oil Tools Installs Two Million Feet of Inflow Control Completion Systems", Jun. 30, 2008 press release, Houston, Tex.

Butler, R. M., "Thermal Recovery of Oil & Bitumen", Chapter 7: "Steam-Assisted Gravity Drainage", Prentice Hall, (1991).

Elliot and Kovscek, "A Numerical Analysis of the Single-Well Steam Assisted Gravity Drainage Process (SW-SAGD)"

Gates and Leskiw, "Impact of steam trap control on performance of steam-assisted gravity drainage," J. Petroleum Sci. Eng. 75:215-22 (2010).

Mazerov, "Innovative systems enhance ability to achieve selective isolated production in horizontal wells," Drilling Contractor May/June 124-129 (2008).

Pao, Richard H. F., "Fluid Mechanics", John Wiley & Sons, pp. 286-290 (1965).

Stalder, "Test of SAGD Flow Distribution Control Liner System, Surmont Field, Alberta, Canada." J. Canadian Petroleum Tech., IN PROCESS

The invention claimed is:

1. A process of steam assisted gravity drainage (SAGD) hydrocarbon production, comprising:

providing a horizontal production well with production tubing and a horizontal injection well with injection tubing, wherein said injection and production tubing are parallel and have a vertical spacing of 3 meters or less in a subterranean hydrocarbon-containing reservoir;

injecting steam into said injection well, wherein said production tubing has a plurality of flow control devices that restricts the flow of steam vapor;

controlling the flow of steam with said flow control devices to maximize steam chamber growth, wherein said flow control devices restrict significant flow of steam vapor into said horizontal production well by causing an increased pressure drop with localized higher flow rate or by discriminating between live steam vapor and liquid water or oil such that live steam vapor is met with a higher pressure drop, thereby preventing steam breakthrough into said production well; and producing hydrocarbons from said production well;

wherein the injection and the producing occur without a startup period, wherein startup period is defined as a period of time for placing said production well and said injection well in fluid communication using heat.

2. The process of claim 1, wherein said flow control devices are only along the production tubing.

3. The process of claim 1, wherein said flow control devices are only along the production tubing and limit steam vapor passage relative to liquids.

4. The process of claim 1, wherein said injection tubing and production tubing have a vertical spacing between 0.5 and 3 meters.

5. The process of claim 1, wherein said injection tubing and production tubing have a vertical spacing of less than 1 meter.

6. The process of claim 1, wherein said flow control devices includes a rate sensitive flow restrictor and a rate sensitive flow valve.

7. The process of claim 1, wherein said hydrocarbons comprises heavy oil, bitumen, tar sands petroleum, asphaltenes, or combinations thereof.

8. A steam assisted gravity drainage (SAGD) hydrocarbon production system, comprising:

a horizontal production well with production tubing placed horizontally in a hydrocarbon reservoir, said production tubing comprising a plurality of flow control devices that restrict the flow of steam vapor relative to liquids and thereby prevents steam breakthrough into said production well; and a horizontal injection well with injection tubing parallel to said horizontal production tubing and vertically spaced 3 meters or less above said horizontal production tubing, wherein said horizontal injection well does not have flow control device;

wherein said horizontal injection well injects steam;

wherein said horizontal production well produces hydrocarbons; and wherein said steam injection and said hydrocarbon production occur without a startup period, wherein startup period is defined as a period of time for placing said horizontal production well and said horizontal injection well in fluid communication using heat.

9. The system of claim 8, wherein said injection tubing and production tubing have a vertical spacing between 0.5 and 3 meters.

10. The system of claim 8, wherein said injection tubing and production tubing have a vertical spacing of less than 1 meter.

11. The system of claim 8, wherein said flow control device is one of a rate sensitive flow restrictor and a rate sensitive flow valve.

12. The system of claim 8, wherein said hydrocarbon reservoir comprises heavy oil, bitumen, tar sands, asphaltenes, or combinations thereof.

13. An improved method of SAGD production of hydrocarbons, said method comprising injecting steam into an upper horizontal well to heat hydrocarbons, allowing gravity drainage of heated hydrocarbons to a lower horizontal well, and producing said heated hydrocarbons from said lower horizontal well, the improvement comprising separating said upper horizontal well and said lower horizontal well by ≤3 meters, and controlling the flow of steam in one or both of said wells using a plurality of flow control device to provide even distribution of steam along said in one or both of said wells and performing the producing step without a startup period, wherein startup period is defined as a period of time for placing said upper horizontal well and said lower horizontal well in fluid communication using heat.

14. The method of claim 13, wherein said flow control device is a flow distribution liner.

15. A process of steam assisted gravity drainage (SAGD) hydrocarbon production, comprising:

a) providing a horizontal production well with production tubing and a horizontal injection well with injection tubing, wherein said injection and production tubing are parallel and have a vertical spacing of 3 meters or less in a subterranean hydrocarbon-containing reservoir and wherein only said production tubing has a plurality of flow control devices that restrict the flow of steam vapor relative to liquids;

b) injecting steam into said injection well;

c) controlling the flow of steam with said one or more flow control devices to maximize steam chamber growth, wherein said flow control devices restrict significant flow of steam vapor into said horizontal production well by causing an increased pressure drop with localized high flow rate or by discriminating between live steam vapor and liquid water or oil such that live steam vapor is met with much higher pressure drop to prevent steam breakthrough to said production well; and d) producing hydrocarbons from said production well;

e) wherein the injecting and the producing steps occur without a startup period of time for putting said production and injection wells into fluid communication using heat.

* * * * *